US007913754B2

(12) United States Patent
Bolding

(10) Patent No.: US 7,913,754 B2
(45) **Date of Patent: *Mar. 29, 2011**

(54) WELLHEAD ASSEMBLY AND METHOD FOR AN INJECTION TUBING STRING

(75) Inventor: Jeffrey L. Bolding, Kilgore, TX (US)

(73) Assignee: BJ Services Company, U.S.A., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/208,646

(22) Filed: Sep. 11, 2008

(65) Prior Publication Data

US 2009/0000781 A1 Jan. 1, 2009

Related U.S. Application Data

(63) Continuation-in-part of application No. 11/972,399, filed on Jan. 10, 2008.

(60) Provisional application No. 60/880,251, filed on Jan. 12, 2007.

(51) Int. Cl.
*E21B 19/00* (2006.01)
*E21B 43/12* (2006.01)

(52) U.S. Cl. ..... 166/90.1; 166/263

(58) Field of Classification Search ..... 166/90.1, 166/305.1, 379, 88.4, 75.14; 285/123.1
See application file for complete search history.

(56) References Cited

U.S. PATENT DOCUMENTS 12,143 A 1/1855 Tucker
2,416,842 A 3/1947 O'Leary
4,022,273 A 5/1977 Marathe
4,387,767 A 6/1983 Read
4,490,095 A 12/1984 Soderberg
4,616,981 A 10/1986 Simmons et al.
4,646,827 A 3/1987 Cobb
5,092,400 A 3/1992 Jagert
(Continued)

FOREIGN PATENT DOCUMENTS

CA 2310236 12/2001
(Continued)

OTHER PUBLICATIONS

Search Report & Written Opinion dated Oct. 12, 2006 from PCT/US2005/35601.

(Continued)

*Primary Examiner* — David J Bagnell
*Assistant Examiner* — James G. Sayre
(74) *Attorney, Agent, or Firm* — Zarian Midgley & Johnson PLLC

(57) ABSTRACT

A wellhead assembly for an injection tubing string is provided which allows a master valve to be closed without damaging the injection tubing string while still allowing for the use of a back pressure valve to isolate the tree. Wellhead assemblies and related methods of the present invention include a wellhead apparatus adapted to be connected to a wellhead. The assembly also includes a mandrel adapted to being inserted into the longitudinal bore of the wellhead apparatus, the mandrel having a port for communicating with an injection port which extends radially through the wellhead apparatus. The assembly further includes a hanger adapted to connect to the upper end of the injection string, wherein the hanger is further adapted to land in the longitudinal bore of the mandrel. The hanger includes a communication passageway for facilitating fluid communication between the port of the mandrel and the injection tubing string.

18 Claims, 14 Drawing Sheets

U.S. PATENT DOCUMENTS

| | | | | |
|---|---|---|---|---|
| 5,148,865 | A * | 9/1992 | Reed | 166/76.1 |
| 5,203,409 | A * | 4/1993 | Seid et al. | 166/95.1 |
| 5,522,464 | A | 6/1996 | Piper | |
| 5,662,169 | A * | 9/1997 | Hosie | 166/344 |
| 5,727,631 | A * | 3/1998 | Baker et al. | 166/379 |
| 5,915,475 | A | 6/1999 | Wells et al. | |
| 6,467,541 | B1 | 10/2002 | Wells | |
| 6,688,386 | B2 | 2/2004 | Cornelssen et al. | |
| 6,715,554 | B1 | 4/2004 | Cunningham et al. | |
| 6,851,478 | B2 | 2/2005 | Cornelssen et al. | |
| 7,025,132 | B2 * | 4/2006 | Kent et al. | 166/87.1 |
| 7,325,600 | B2 | 2/2008 | Sieben | |
| 7,699,099 | B2 | 4/2010 | Bolding et al. | |
| 2002/0000315 | A1 | 1/2002 | Kent et al. | |
| 2002/0011336 | A1 * | 1/2002 | Baskett et al. | 166/368 |
| 2002/0134548 | A1 | 9/2002 | Lam et al. | |
| 2004/0112604 | A1 | 6/2004 | Milberger et al. | |
| 2004/0154790 | A1 | 8/2004 | Cornelssen et al. | |
| 2004/0262010 | A1 | 12/2004 | Milberger | |
| 2005/0022998 | A1 | 2/2005 | Rogers, Jr. | |
| 2005/0175476 | A1 | 8/2005 | Patterson | |
| 2005/0249613 | A1 | 11/2005 | Jordan et al. | |
| 2006/0008364 | A1 | 1/2006 | Traylor | |
| 2008/0029271 | A1 | 2/2008 | Bolding et al. | |

FOREIGN PATENT DOCUMENTS

| | | |
|---|---|---|
| CA | 2497090 | 8/2006 |
| EP | 0637675 | 2/1995 |
| GB | 2377954 | 1/2003 |
| WO | WO9904137 | 1/1999 |
| WO | WO 9904137 A1 * | 1/1999 |

OTHER PUBLICATIONS

Examiner's Second Examination Report dated Mar. 22, 2010 from related AU Patent Application No. AU2006279282.
Examiner's First Report dated Nov. 2, 2009 from related AU Patent Application No. AU2006279282.
First Exam Report dated Nov. 23, 2009 from related CA Patent Application No. 2619570.
Search Report and Written Opinion dated Sep. 27, 2007 from PCT Application No. PCT/US2006/32504.
Office Action dated Feb. 1, 2010 from related U.S. Appl. No. 11/463,937.
Final Office Action dated Sep. 16, 2009 from related U.S. Appl. No. 11/463,937.
International Preliminary Report on Patentability dated Feb. 12, 2009 from related PCT Application No. PCT/US2007/017226.
International Search Report & Written Opinion dated Jan. 18, 2008 from related PCT Application No. PCT/US2007/017226.
Office Action dated Mar. 13, 2009 from related U.S. Appl. No. 11/461,858.
Office Action dated Aug. 4, 2008 from related U.S. Appl. No. 11/461,858.
Office Action dated Apr. 17, 2007 from U.S. Appl. No. 11/057,214.
Office Action dated Jun. 19, 2009 from related U.S. Appl. No. 11/461,858.
Office Action dated Dec. 31, 2008 from related U.S. Appl. No. 11/461,858.
"Conventional DHSV Coiled Tubing Completion" obtained from http://www.pedcor.com/wellhead-equipment/conventional_dhsv_ct_completion.html, 3-pgs.
"RF Hanger from PEDCOR" obtained from http://www.pedcor.com/wellhead-quipment/rf_hanger.html, 3-pgs.
PEDCOR "Series 10-400 Chemical Injector Adaptor" dated Jan. 5, 1995.
PEDCOR "Wellhead Equipment Sub: Standard Hanger Mandrel Type" obtained from http://www.pedcor.com/wellhead-equipmnet/standard_mandrel_hanger.html, 3-pgs.
Select Energy Systems, "Installation Procedure: Model 2500 CT Hanger", undated, obtained from http://www.selectesi.com/select_energy/PDFs/02.pdf, 2-pgs.
Select Energy Systems, "Model 2500 Flanged CT Hanger", Publisher: undated, obtained from http://www.selectesi.com/select_energy/PDFs/04.pdf, 1-pg.
Select Energy Systems, "Model 2500R Flanged CT Hanger", Publisher: undated, obtained from http://www.selectesi.com/select_energy/PDFs/01.pdf, 1-pg.
Office Action dated Sep. 15, 2009 from related U.S. Appl. No. 12/208,646.
Office Action dated Mar. 9, 2010 from related U.S. Appl. No. 12/208,646.
International Search Report and Written Opinion dated Apr. 23, 2008 from related PCT Application No. PCT/US2008/050752.
Office Action dated Sep. 15, 2009 from related U.S. Appl. No. 11/972,399.
Office Action dated Mar. 24, 2010 from related U.S. Appl. No. 11/972,399.
Canadian Office Action dated Aug. 13, 2008 from related Canadian Application No. CA 2,497,090.
Office Action dated Oct. 20, 2006 from related U.S. Appl. No. 11/057,214.
U.S. Appl. No. 11/463,937, filed Aug. 11, 2006 in the name of Jeffrey L. Bolding.
U.S. Appl. No. 11/664,646, filed Feb. 27, 2008, in the name of Jeffrey L. Bolding, et al.
U.S. Appl. No. 11/972,399, filed Jan. 10, 2008, in the name of Jeffrey L. Bolding, et al.
U.S. Appl. No. 12/420,425, filed April 8, 2009, in the name of Jeffrey L. Bolding.

* cited by examiner

WELLHEAD ASSEMBLY AND METHOD FOR AN INJECTION TUBING STRING

PRIORITY

This application is a continuation-in-part of application Ser. No. 11/972,399, filed Jan. 10, 2008, entitled "WELLHEAD ASSEMBLY AND METHOD FOR AN INJECTION TUBING STRING," which claims the benefit of U.S. Provisional Application No. 60/880,251, filed Jan. 12, 2007, entitled "WELLHEAD ASSEMBLY FOR AN INJECTION TUBING STRING," which is hereby incorporated by reference in its entirety.

BACKGROUND OF THE INVENTION

1. Field of the Invention

The present invention relates generally to a wellhead assembly for an oil and gas well. More particularly, the present invention relates to a wellhead assembly or hanger for a coiled tubing string which has annular communication.

2. Description of the Related Art

It is often desirable in the oilfield industry to insert a string of coiled tubing into the production tubing of a completed oil and gas well. The coiled tubing may be used for a number of purposes such as chemical injection, gas injection, cross sectional area reduction, or for carrying downhole equipment such as sensors, gauges, and pumps. Traditional coiled tubing is a continuous length of spoolable pipe, ranging in size from ¾" to 3" OD. Smaller diameters, such as ¼ " or ⅜" OD, are sometimes referred to as a capillary string or an injection tubing string. As used hereinafter, such tubing will be referred to as an injection tubing string, although such use is not intended to limit the scope of the invention or exclude other comparable tubing strings.

It is also desirable to leave the injection tubing string in the wellbore for extended periods of time. This allows an operator, for example, to inject chemicals into the wellbore, on a continual basis, to enhance production or to inhibit corrosion, scale, hydrate or paraffin buildup in the well bore. U.S. Pat. No. 6,851,478 discloses a Y-body Christmas tree for use with an injection tubing string, thereby allowing for the essentially permanent installation of the injection tubing string. The Y-body Christmas tree provides convenient access for injecting coiled tubing into a tubing string without necessarily adding height to the wellhead or tree. The Y-body Christmas tree includes a vertical fluid flow bore for passage and containment of the production of oil and gas from the wellbore. The tree includes upper and lower master valves for controlling the passage of well flow through the tree and to an adjoining flow line. The Y-body Christmas tree also includes an independent angular coiled tubing bore that intersects the vertical flow bore of the tree between the upper and lower master valves, allowing the upper master valve to be cycled without being obstructed by a coil string.

The Y-body Christmas tree has at least three drawbacks. First, the tree is more expensive than a conventional Christmas tree. Secondly, when the injection tubing string is installed in the production tubing, the lower master valve cannot be closed without severing the injection tubing string and requiring an expensive fishing job to remove the severed tubing string. Furthermore, when the tubing injection string is installed in the production tubing, the back pressure valve preparation in the tubing hanger is no longer available for installing a back pressure valve, without first removing the injection tubing string. In the event that the upper master valve begins to leak and needs to be repaired or replaced, an operator cannot obtain a double barrier required in many locations throughout the world by closing the lower master valve or installing a back pressure valve in the production tubing. As a result, an operator would have to mobilize a workover rig and/or lift boat so that the injection tubing string can be removed from the production tubing to allow the lower master valve to be closed and/or a back pressure valve to be installed. This is obviously a time consuming and expensive proposition.

Thus, there is a need for an alternative method for suspending an injection tubing string in production tubing that addresses the problems discussed above.

SUMMARY OF THE INVENTION

According to embodiments of the present invention, a wellhead assembly and method for an injection tubing string is provided herein. An exemplary embodiment of a wellhead assembly comprises a flange adapted to be connected to a wellhead, the flange having a longitudinal bore therethrough and an injection port extending radially through the flange and communicating with the longitudinal bore. The assembly includes a mandrel adapted to be inserted into the longitudinal bore of the flange, the mandrel having a longitudinal bore therethrough and a port for communicating with the injection port of the flange. The assembly further includes a hanger adapted to be connected to the upper end of an injection string, the hanger being further adapted to land in the longitudinal bore of the mandrel wherein the hanger includes a communication passageway for facilitating fluid communication between the port of the mandrel and the injection tubing string.

According to one embodiment, at least a portion of the mandrel's longitudinal bore serves as a polished bore receptacle. At least a portion of the flange's longitudinal bore also serves as a polished bore receptacle. The mandrel preferably includes seals for sealing the annular area between the flange's polished bore and the outer diameter of the mandrel. The seals seal the annular space above and below the injection port in the flange and the port extending through the mandrel. The injection tubing string hanger preferably includes seals for sealing the annular space between the mandrel's polished bore and the outer diameter of the hanger. The seals seal the annular space above and below the fluid passageway extending laterally through the hanger and the port extending through the mandrel.

In a preferred embodiment, the flange is inserted between the top of the production tubing head spool and the bottom of the Christmas tree. More particularly, the flange is connected beneath the lower master valve of the Christmas tree.

According to one embodiment, the injection tubing string is connected to the hanger by a ferrule fitting. A live swivel is preferably installed between the ferrule fitting and the injection string to allow rotation of the hanger without imparting rotation to the injection tubing string.

According to one embodiment, external threads are provided proximate to the lower end of the mandrel for connecting the mandrel to the back pressure valve thread profile in the production tubing hanger. The mandrel may also include an external seal for sealing the annular space between the mandrel and the production tubing hanger. The mandrel may include internal threads for receiving a back pressure valve in the longitudinal bore of the mandrel above the injection tubing string hanger. The hanger is preferably threadedly attached to the internal diameter of the mandrel to lock the hanger in place. Alternatively, the hanger may have a keyed connector which may be locked in place with minimal turning of the hanger relative to the mandrel. The hanger may also be locked in place with one or more snap rings which snap into mating recesses in the internal diameter of the mandrel. When locked in place, the hanger provides a straddled seal across the communication port with the mandrel. The hanger further provides a profile for connecting to a running tool. The hanger also provides annular flow area for production of oil and gas past the hanger and into the Christmas tree. Once installed, chemicals for treating the wellbore may be injected through the injection port of the flange, through the port in the mandrel, through the communication passageway of the hanger and into the injection tubing string.

In an alternative embodiment, a wellhead assembly for an injection tubing string is provided which comprises a wellhead apparatus having a longitudinal bore therethrough and an injection port extending through the wellhead apparatus and communicating with the longitudinal bore of the wellhead apparatus. The wellhead assembly also includes a mandrel adapted to be inserted into the longitudinal bore of the wellhead apparatus, the mandrel comprising a longitudinal bore therethrough and a port, the port extending through the mandrel for communicating with the injecting port of the wellhead apparatus. The assembly further comprises a hanger connected to the injection tubing string, the hanger being adapted to land in the longitudinal bore of the mandrel, wherein the hanger includes a communication passageway which facilitates fluid communication between the port of the mandrel and the injection tubing string. The wellhead apparatus may be a tubing head adapter, a master gate valve, a multi block Christmas tree, or a spacer, such as a spacer spool, a tubing bonnet, a bleed ring, a bleed ring gasket or an instrument flange.

In a preferred embodiment, the mandrel is adapted to land and lock in the back pressure valve profile in the production tubing hanger. The mandrel may also include an internal profile for receiving a back pressure valve.

Another embodiment of the invention is directed to a method for injecting fluid through a wellhead assembly and into an injection tubing string comprising the step of mounting a wellhead assembly to a wellhead, the wellhead assembly comprising a wellhead apparatus adapted to be connected to the wellhead and having a longitudinal bore therethrough and a fluid injection port, a mandrel adapted to be inserted into the longitudinal bore of the wellhead apparatus, the mandrel having a bore therethrough and a port, and a hanger connected to the injection tubing string, the hanger adapted to land inside the bore of the mandrel, the hanger having a communications passageway facilitating fluid communication between the port of the mandrel and the injection tubing string. The method further comprising the steps of injecting fluid through the fluid injection port of the wellhead apparatus, through the port of the mandrel, through the communication passageway of the hanger and through the injection tubing string.

A preferred embodiment of a method for injecting fluids into a well comprises the steps of replacing a first wellhead apparatus on a wellhead with a second wellhead apparatus having substantially the same dimensions as the first wellhead apparatus, the second apparatus having a longitudinal bore extending therethrough and providing the second wellhead apparatus with an injection port that communicates with the longitudinal bore of the second wellhead apparatus. The method further includes the steps of installing a mandrel in the longitudinal bore of the second wellhead apparatus, the mandrel having a longitudinal bore therethrough and a port, connecting an injection tubing string to a hanger and landing the hanger in the longitudinal bore of the mandrel, the hanger having a passageway to facilitate fluid communication between the port of the mandrel and the injection tubing string. The method further comprises injecting fluid through the injection port of the wellhead apparatus, through the port in the mandrel, through the passageway of the hanger and into the injection tubing string. By using a second wellhead apparatus having substantially the same dimensions as the first wellhead apparatus, the overall height of the wellhead and Christmas tree is kept the same so that existing flow lines leading from the tree can be utilized without extensive modification. The present invention is particularly well-suited for adding a chemical injection line to an existing offshore well where raising the height of the wellhead or tree is undesirable in light of cost, space and other restraints related to modifications to existing flow lines for the well.

Injected fluids may include gas, foamers, acids, surfactants, miscellar solutions, corrosion inhibitors, scale inhibitors, hydrate inhibitors, paraffin inhibitors, or any other chemicals that may increase the quality and/or quantity of production fluids flowing to the surface.

Figure 1:
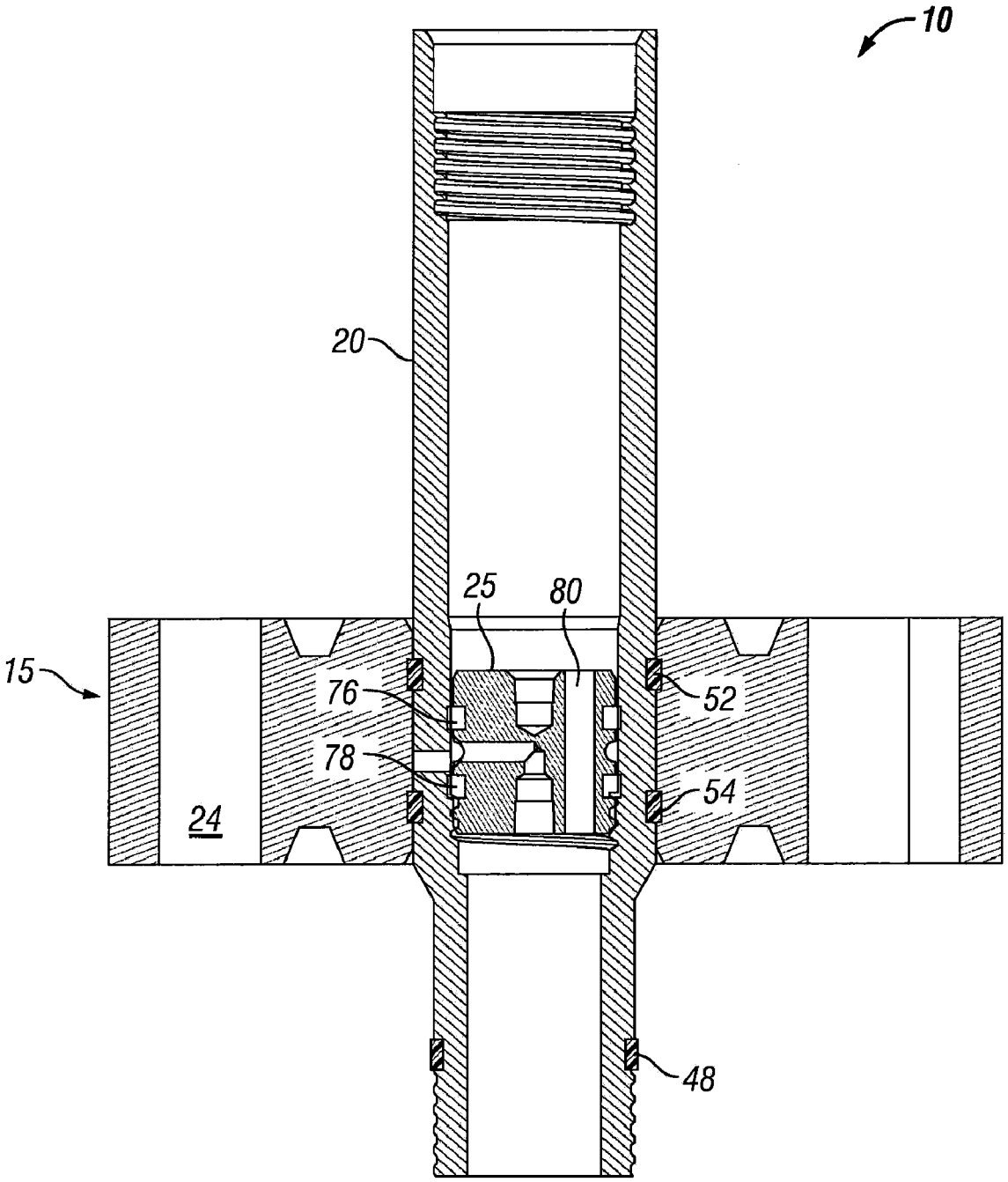
FIG. 1 is a cross-sectional view of an exemplary embodiment of the injection string wellhead assembly.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DETAILED DESCRIPTION OF THE INVENTION

Illustrative embodiments of the invention and related methods are described below as they might be employed in the use of a wellhead assembly for an injection tubing string that extends into a production tubing string. In the interest of clarity, not all features of an actual implementation or related method are described in this specification. It will of course be appreciated that in the development of any such actual embodiment or method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2A:
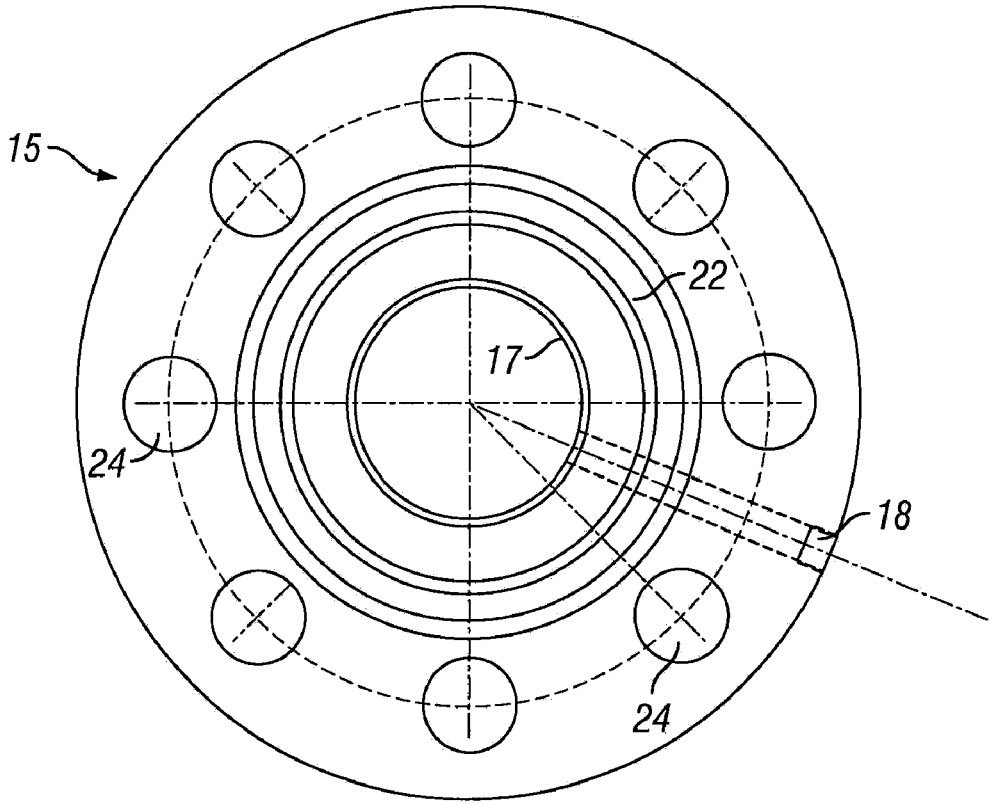
FIGS. 2A-C are sectional views of an exemplary embodiment of a flange of the injection string wellhead assembly.
Figure 2B:
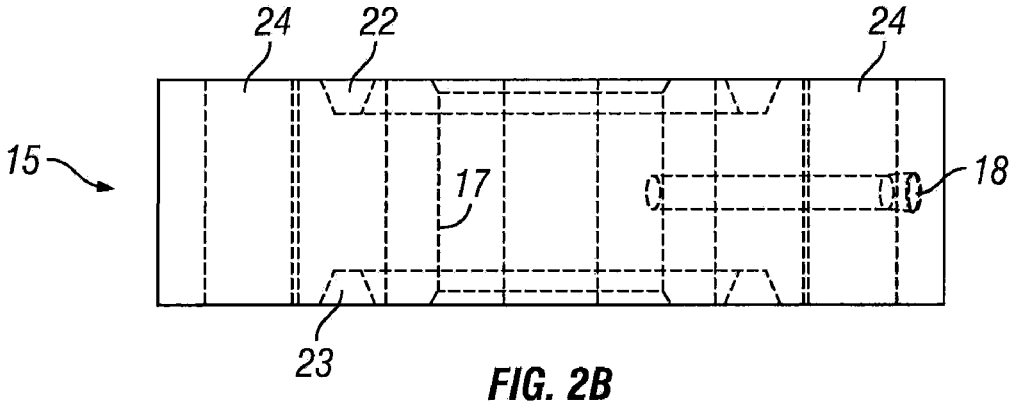
Figure 2C:
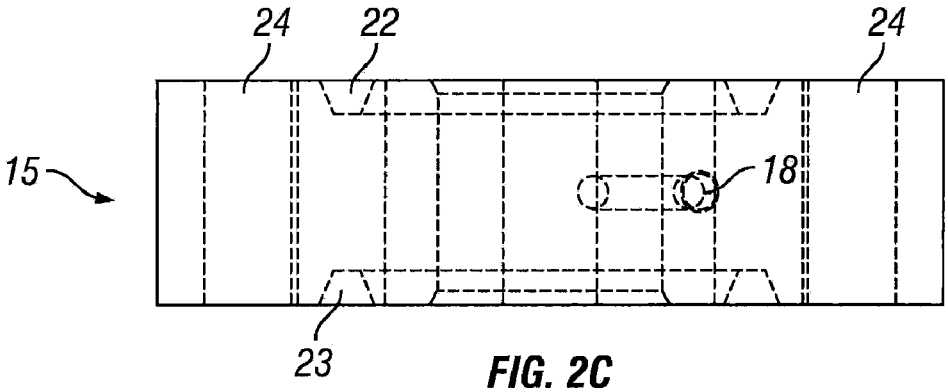

Referring to FIG. 1, one embodiment of a wellhead assembly 10 for an injection tubing string is illustrated. The injection tubing string wellhead assembly 10 includes flange 15, mandrel 20 and tubing hanger 25. Flange 15, as more clearly illustrated in FIGS. 2A-2C. Flange 15 includes a longitudinal bore 17 extending through the center of the flange. Injection port 18 extends radially through the flange and into longitudinal bore 17. As will be understood by one of skill in the art, chemicals for treating a wellbore may be injected via a surface injection line (not shown) through injection port 18. Flange 15 is preferably inserted between the existing wellhead and the tubing head adapter for a given well. More particularly, the flange is adapted to be inserted between and connected to the upper flange of the production tubing head adapter spool and the lowermost flange of the lower master valve of the Christmas tree. One of skill in the art will appreciate that flange 15 may be inserted at the time that the injection tubing string is to be installed, or it may be installed with the initial Christmas tree installation. In the latter case, the remaining components of assembly 10 could then be installed at a subsequent time when chemical injection is required.

A plurality of bolt holes 24 are included about the outer circumference of the flange which will align with corresponding holes in the flanges of the production tubing spool (or tubing spool adapter if the latter is required) and lower master valve flange. By way of example, flange 15 includes 8 bolt holes for receiving bolts (not shown) to securely connect flange 15 between the production tubing head spool and the bottom of the lower master valve. Flange 15 includes an upper annular groove 22 and a lower annular groove 23 for receiving ring gasket seals (not shown), to seal the flange to the lower master valve and production tubing head spool.

Preferably, longitudinal bore 17 extending through the flange has the same diameter as the internal bore of the Christmas tree. For example, with 3½ inch production tubing, the Christmas tree will have a 3¹⁄₁₆ inch internal bore extending therethrough and flange 15 will have a similar 3¹⁄₁₆ inch inner diameter, or slightly less to accommodate easier insertion of the mandrel. At least a portion of internal bore 17 will serve as a polished bore receptacle to provide a sealing surface for mandrel 20.

Figure 3:
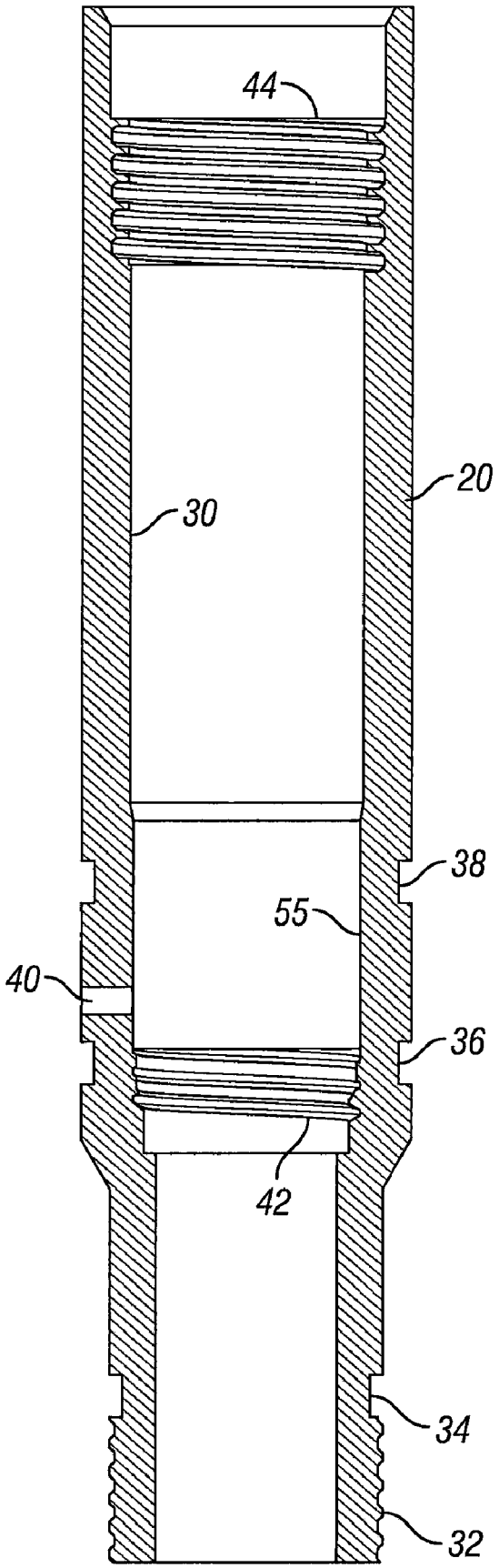
FIG. 3 is a cross-sectional view of an exemplary embodiment of a mandrel of the injection string wellhead assembly.

Referring to FIGS. 1 and 3, the injection tubing string wellhead assembly includes mandrel 20. Mandrel 20 has a generally cylindrical shape with a longitudinal bore 30 extending therethrough. Mandrel 20 includes external threads on its lowermost end which are adapted to mate with a threaded profile on the internal diameter of the production tubing hanger in a set of threads known as "back pressure threads" (not shown). Threads 32 mate with the threaded profile in the tubing hanger that is conventionally used to receive a back pressure valve for the production tubing. One of skill in the art will appreciate that the back pressure valve thread profile in the production tubing hanger may differ depending on the supplier of the hanger. The profile for threads 32 on the mandrel will be selected to match the thread profile of the back pressure valve threads. Threads 32 provide a downward anchoring and compression means to compress an elastomer seal 48 when mandrel 20 is properly made up into the threaded profile or back pressure threads of the tubing hanger. When properly made up, threads 32 lock mandrel 20 to the tubing hanger. Mandrel 20 may also include an annular groove 34 for receiving a seal ring 48 which also seals the annular space between the lower end of mandrel 20 and the production tubing hanger.

Mandrel 20 includes a flow port 40 for communicating with injection port 18. Mandrel 20 also includes upper annular recess 38 and lower annular recess 36 for receiving seal rings 52 and 54, respectively. Ring seals 52 and 54 seal the annular area between mandrel 20 and bore 17 of flange 15. Seals 52 and 54 keep injection chemicals from leaking between mandrel 20 and flange 15.

Bore 30 of the mandrel includes a threaded profile 42 for receiving the mating threads on injection tubing string hanger 25. One of skill in the art will appreciate that various types of thread profiles 42 may be used to attach and lock hanger 25 to mandrel 20. Alternatively, the mandrel may include one or more recesses for receiving snap ring(s) on the external decimeter of hanger 25 to lock the hanger to the mandrel. External keys on the outer diameter of hanger 25 and mating profiles on the internal diameter of the mandrel could also be used to attach and lock the hanger to the mandrel. The mandrel may include an upper profile 44 for receiving a conventional back pressure valve (not shown). Mandrel 20 includes a polished bore section 55 that provides a sealing surface for tubing hanger 25.

Figure 10B:
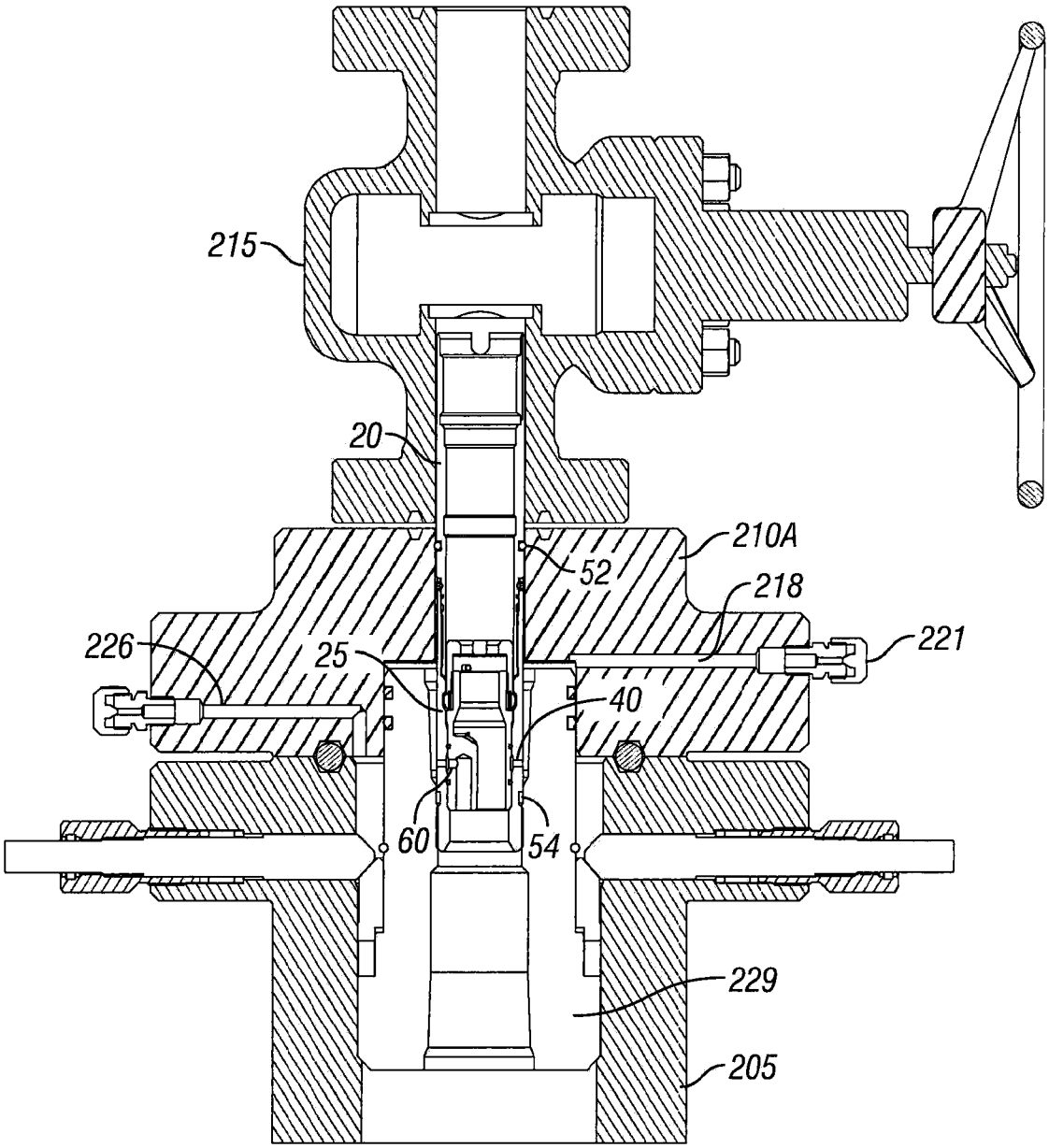
Figure 11A:
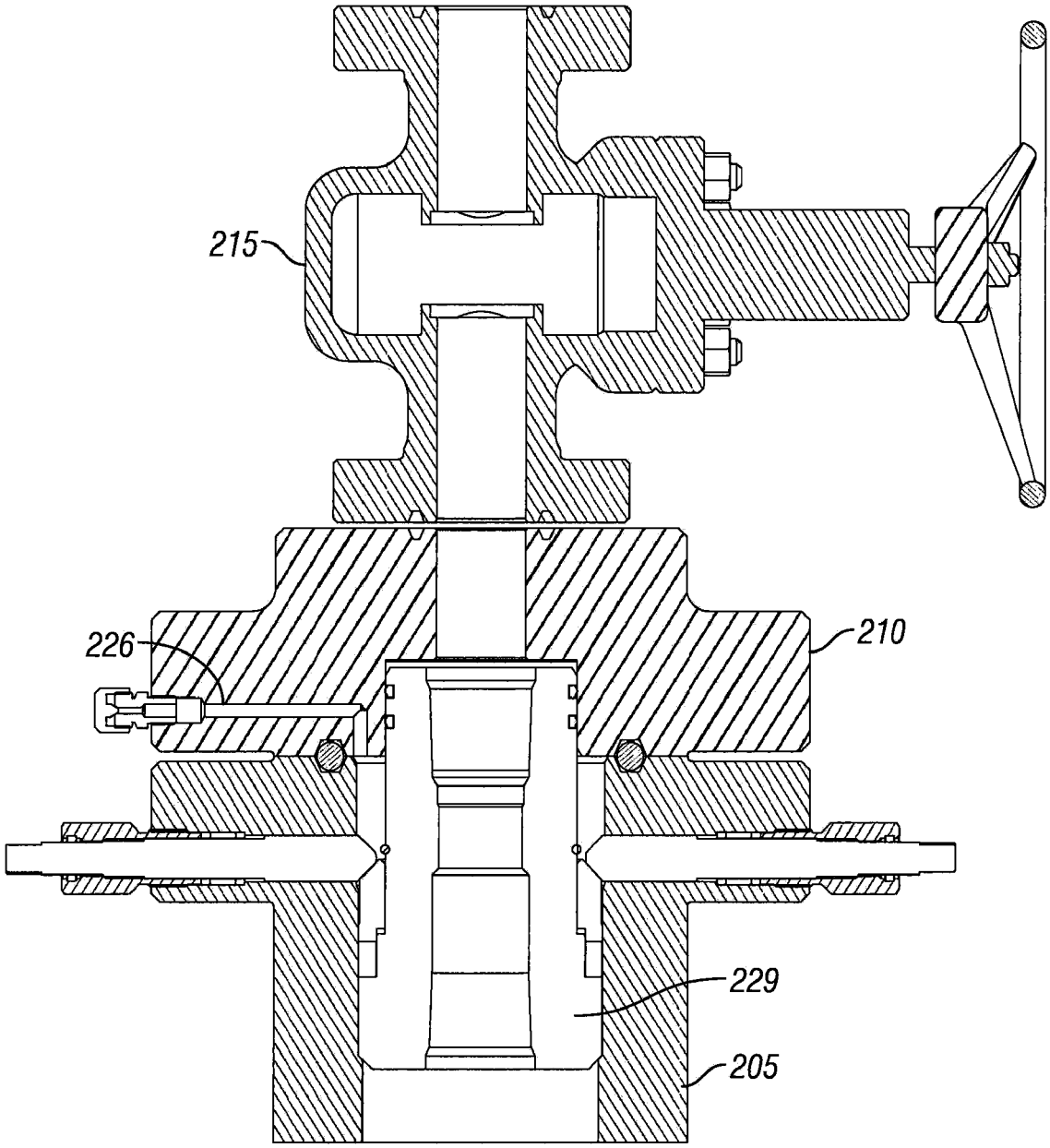
FIGS. 11A and 11B are cross-sectional views of a well before and after installation of an exemplary embodiment of the injection string wellhead assembly.
Figure 11B:
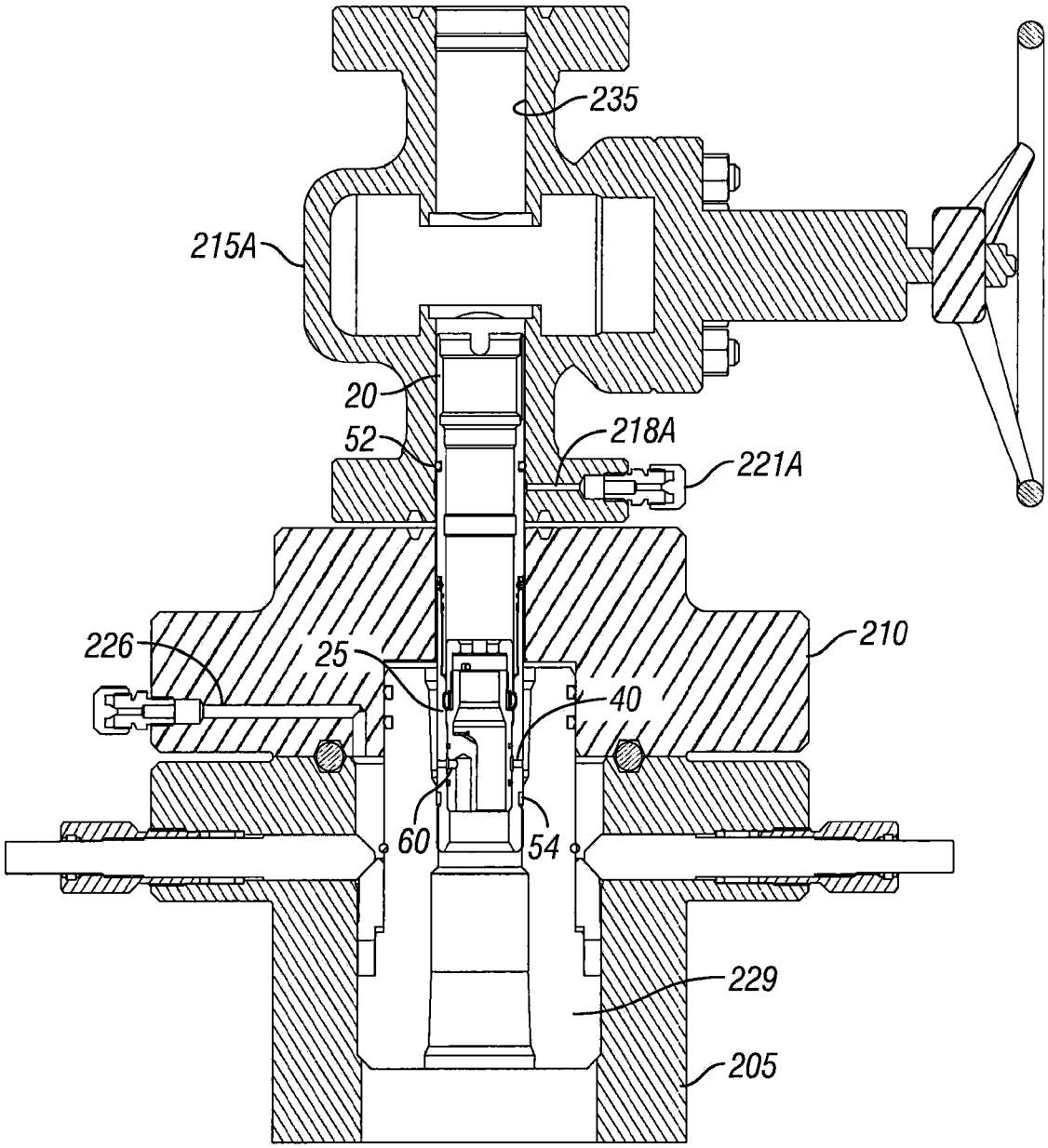

Referring to FIGS. 1 and 4A-4C, one embodiment of the tubing hanger 25 of the present invention is shown in more detail. Hanger 25 includes an internal communications passageway 60 for communicating with mandrel flow port 40, injection port 18 and the injection tubing string. In a preferred embodiment, passageway 60 extends radially from its opening on the outer periphery of hanger 25 to the center of the hanger, where a portion of passageway 60 extends axially into the profile 62, thereby allowing communication with the top of the injection tubing string (not shown). In an alternative embodiment (such as shown in FIGS. 10B, 11B, and 12B), profile 62 is located closer to one side of the hanger instead of in the center of the hanger, thus shortening the length of passageway 60. In a preferred embodiment, hanger 25 includes an annular channel 75 which extends about the opening to passageway 60 to facilitate communications with flow port 40. Channel 75 allows communication between passageway 60 and flow port 40 even though passageway 60 is not radially aligned with port 40. In a similar manner, an annular channel (not shown) between mandrel 20 and flange 15 may be used to facilitate communications between injection port 18 and flow port 40. This annular channel may, for example, extend about bore 17 of the flange and/or the outer diameter of mandrel 20 (between recesses 36 and 38).

Hanger 25 includes annular grooves 72 and 74 for receiving seal rings 76 and 78 respectively to seal the annular space between hanger 25 and mandrel 20 above and below flow port 40, flow channel 75 and passageway 60. Thus, injected chemicals can be injected through injection port 18, through flow port 40 and into channel 75 where the chemicals will flow until it reaches passageway 60, whereafter the chemicals can pass into the injection tubing string connected to hanger 25.

The injection tubing string (not shown) is preferably attached to hanger 25 with a ferrule connector, which fits inside profile 62 of hanger 25. Hanger 25 may include an enlarged profile 65 for receiving a live tubing swivel which allows hanger 25 to be rotated relative to mandrel 20 without imparting rotation to the tubing string. During installation, hanger 25 will preferably be rotated into locking engagement with mandrel 20. Live tubing swivels (not shown) are well known and are not described herein. In embodiments using snap rings to lock the hanger to the mandrel, rotation of the hanger is not necessary and therefore, live tubing swivels may be omitted. Seals 76 and 78 on the hanger preferably seal inside polish bore 55 of mandrel 20.

Figure 4A:
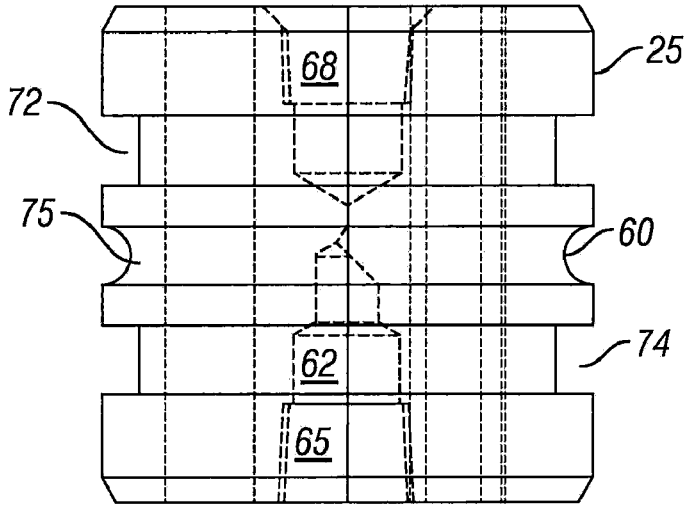
FIGS. 4A-C are sectional views of an exemplary embodiment of an injection string hanger for the injection string wellhead assembly.
Figure 4B:
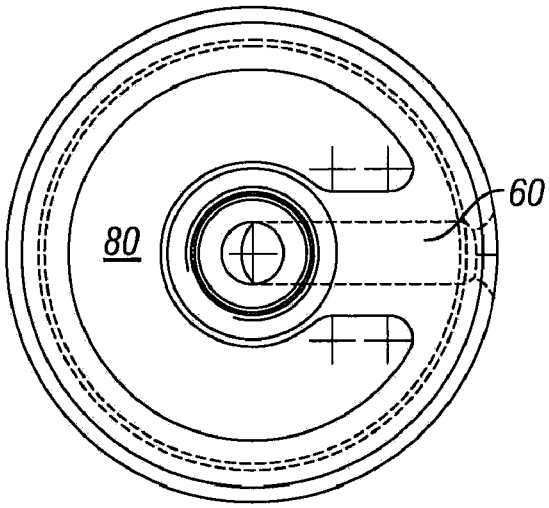
Figure 4C:
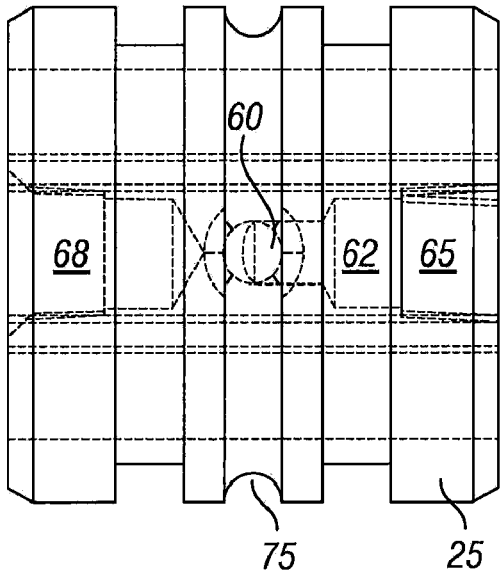

FIG. 4B illustrates a top view of hanger 25, which provides a C-shaped flow area 80 for the production of oil and gas and other wellbore fluids up through the production tubing, past hanger 25 and into the Christmas tree and out surface production lines for the well. Hanger 25 also includes an internal profile 68 on its upper end for receiving a running tool.

To install the injection tubing string wellhead assembly on an existing well, the Christmas tree is disconnected from the production tubing head spool. Flange 15 is then inserted on top of the production tubing head spool (or tubing head adapter if present) and the tree is re-installed. Once the tree is re-installed, flange 15 will be connected to the bottom flange of the lower master valve. The mandrel is sized so that it can be run through the bore of the Christmas tree.

Hanger 25 and the injection tubing string suspended therefrom is run into the well after the Christmas tree has been nippled up to flange 15 and the tubing head spool. In one embodiment of the invention, the injection tubing string wellhead assembly is used with BJ Services' InjectSafe™ System which includes upper and lower injection strings, the lower injection string extends from a wireline retrievable surface controlled subsurface safety valve. The subsurface safety valve may be either a tubing retrievable safety valve or be a wireline insert safety valve installed, for example, inside a production subsurface safety valve. The upper injection string will sting into the InjectSafe™ downhole safety valve and will communicate with the lower injection string through a bypass which bypasses the valve mechanism of the safety valve. In a preferred embodiment, hanger 25 is run with the upper portion of the injection string. Once the downhole safety valve and lower injection string have been set in the well, the upper string is spaced-out and cut and connected to hanger 25 via a ferrule connector. A live tubing swivel may extend between the ferrule connector and the injection tubing string. A running tool is connected to profile 68 of hanger 25 and the injection string and hanger are lowered into the well through the Christmas tree until the hanger lands in profile 42 of mandrel 20. After the mandrel is connected to profile 42 of the mandrel, the running tool is disconnected from the hanger and removed from the wellbore.

Figure 5:
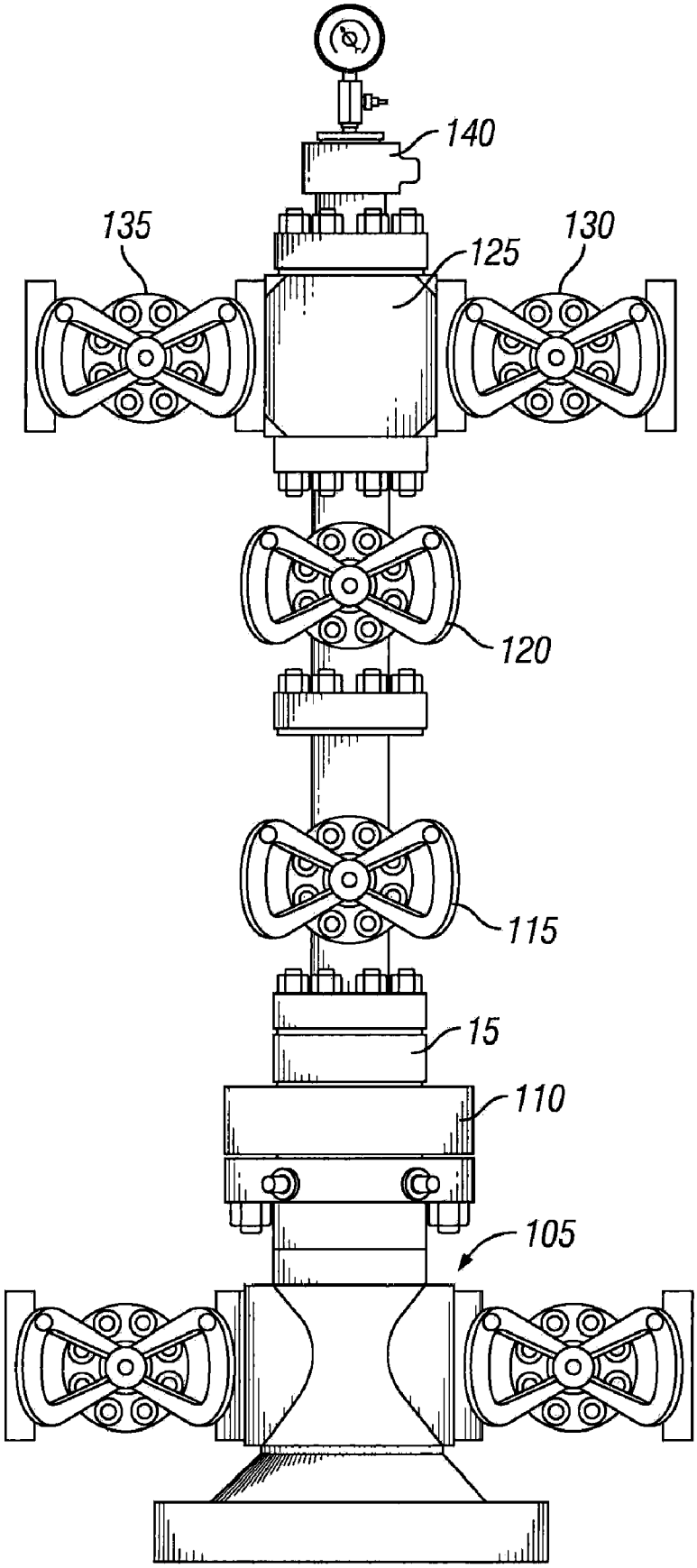
FIG. 5 is a side view of an exemplary embodiment of the flange positioned between a conventional dual master valve Christmas tree and a conventional tubing head.

FIG. 5 illustrates one embodiment of the present invention used with a conventional dual master valve Christmas tree. As shown in FIG. 5, flange 15 is installed beneath lower master gate valve 115. Flange 15 is installed on top of tubing head adapter 110, which is connected to the top of tubing head 105. Upper master gate valve 120 is connected to the upper end of lower master gate valve 115. Studded cross 125 is mounted to the top of upper master gate valve 120. Top connector 140 is connected to the top of studded cross 125. Flow line gate valve 130 and kill line gate valve 135 are attached on opposite sides of studded cross 125. As can be seen from FIG. 5, flange 15 is located beneath both master valves of the Christmas tree.

The height of mandrel 20 is selected such that it will extend into the lower bore of the lower master valve but will not interfere with the operation (i.e., closing) of the lower master valve. Thus, both mater valves remain functional after installation of injection wellhead assembly 10, thereby allowing the master valves to be closed without cutting or damaging the injection tubing string suspended from hanger 25.

Figure 6:
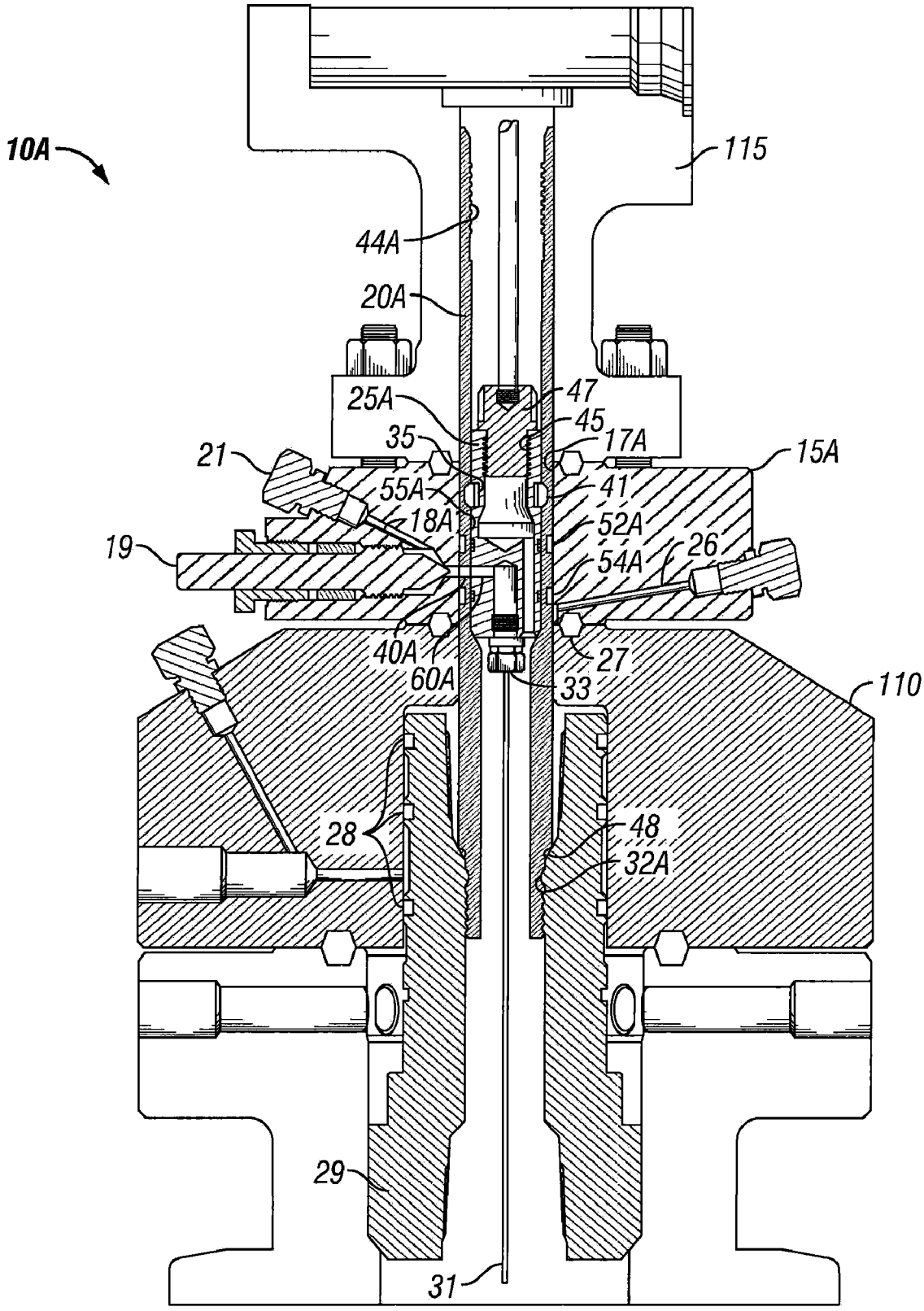
FIG. 6 is a cross-sectional view of an exemplary embodiment of the injection string wellhead assembly.
Figure 7:
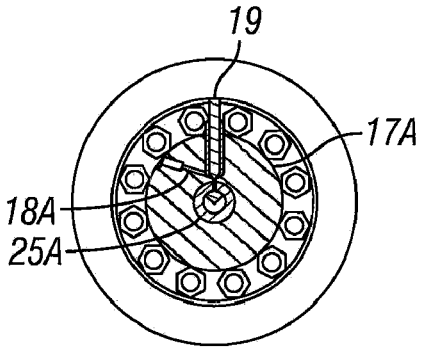
FIG. 7 is a sectional top-side view of an exemplary embodiment of a flange of the injection string wellhead assembly.

Referring to FIGS. 6 and 7, an alternative exemplary embodiment of wellhead assembly 10 is illustrated. The wellhead assembly 10A includes flange 15A, mandrel 20A and tubing hanger 25A. Flange 15A includes longitudinal bore 17A extending through the center of flange 15A. Injection port 18A extends radially through flange 15A into the longitudinal bore. In general, each component works are previously discussed with some added features which will be outlined below.

In the exemplary embodiments of FIGS. 6 and 7, flange 15A operates the same as discussed in relation to previous embodiments. However, in this embodiment, an integral needle valve 19, as well known in the art, also extends radially through flange 15A and into port 18A, thereby regulating fluid communication through port 18A. A grease fitting 21 may also be used to seal port 18A when desired. As will be understood by one of skill in the art, chemicals for treating a wellbore may be injected via a surface injection line (not shown) through injection port 18A.

Further referring to the exemplary embodiment of FIG. 6, flange 15A is mounted between lower master valve 115, which is above flange 15A, and tubing head adapter 110, which is below flange 15A. One of skill in the art will appreciate that flange 15A may be mounted at the time the injection tubing string is installed or it may be mounted with the initial Christmas tree installation. In the latter case, the remaining components of assembly 10A could then be installed at a subsequent time when chemical injection is required. Flange 15A also includes seals 27 in order to seal flange 15A to lower master valve 115 and tubing head adapter 110. Seals 27 may be, for example, ring gaskets seals.

A test port 26, as known in the art, extends radially through flange 15A in order to test the integrity of seals 27, 28 (uppermost seal) and 48. A plurality of bolt holes (not shown) are spaced about the other circumference of flange 15A which align with corresponding holes in the flanges of the lower master valve 115 and tubing head adapter 110. Any number of bolt holes may be included as desired.

As discussed in relation to previous embodiments, preferably, longitudinal bore 17A has the same diameter as the internal bore of the Christmas tree. However, flange 15A may have a slightly smaller diameter than that of the Christmas tree bore in order to accommodate easier insertion of the mandrel 20A. At least a portion of bore 17A will serve as a polished bore receptacle to provide a sealing surface for mandrel 20A.

Further referring to the exemplary embodiment of FIG. 6 and as previously discussed in other embodiments, mandrel 20A has a generally cylindrical shape with a longitudinal bore extending therethrough. Mandrel 20A includes external threads 32A on its lowermost end which are adapted to mate with a threaded profile on the internal diameter of the production tubing hanger 29 in a set of threads known as "back pressure threads" (not shown). Threads 32A mate with the threaded profile in the tubing hanger that is conventionally used to receive a back pressure valve for the production tubing. One of skill in the art will appreciate that the back pressure valve thread profile in the production tubing hanger 29 may differ depending on the supplier of the hanger. The profile for threads 32A will be selected to match the thread profile of the back pressure valve threads. Threads 32A provide a downward anchoring and compression means to compress elastomer seals 48 which also seal the annular space between the lower end of mandrel 20A and production tubing hanger 29. Seals 28 are used to seal the annular space between tubing hanger 29 and tubing head adapter 110.

As also discussed in previous embodiments, mandrel 20A includes flow port 40A for communicating with injection port 18A. Mandrel 20A includes annular seals 52A and 54A (and their corresponding recesses) for sealing the annular space between mandrel 20A and bore 17A of flange 15A. Seals 52A and 54A keep injection chemicals from leaking between mandrel 20A and flange 15A. Mandrel 20A may also include upper threaded profile 44A for receiving a convention back pressure valve (not shown). Mandrel 20A also includes a polished bore section 55A that provides a sealing surface for tubing hanger 25A.

In general, hanger 25A operates the same as discussed in relation to the previous embodiments. Therefore, chemicals can be injected through injection port 18A, through flow port 40A and into channel 75A (not shown in FIG. 6) where the chemicals will flow until it reaches passageway 60A, whereafter the chemicals can pass into the injection tubing capillary string 31 connected to hanger 25A. Injection tubing string 31 is preferably attached to hanger 25A with a connector 33, such as for example, a ferrule or swivel connector, which fits inside hanger 25A.

In the exemplary embodiment of FIG. 3, the longitudinal bore of mandrel 20 included a threaded profile 42 for receiving mating threads on hanger 25. However, one of skill in the art will appreciate that various types of connectors, such as for example, snap rings, may be used to attach and lock hanger 25 to mandrel 20. For example, in the alternative exemplary embodiment of FIG. 6, hanger 25A includes annular recess 35 on its upper end for receiving a C-ring 41, such as, for example, a snap ring or spring-loaded dog. C-ring 41 is used to lock hanger 25A into place within mandrel 20A and prevents hanger 25A from moving uphole during operation. Once installed, C-ring 41 will mate with corresponding annular profiles within the longitudinal bore of mandrel 20A, thereby locking hanger 25A into position for fluid communication. Although disclosed as a C-ring at the upper end of hanger 25A, those of skill in the art will realize that any variety of locking mechanisms, as well as placements along hanger 25A, may be utilized to secure hanger 25A in place. An internal threaded profile 45 is located at the upper end of hanger 25A for receiving a running tool 47. However, those of skill in the art will understand that any variety of connectors could be used for this purpose.

Figure 8:
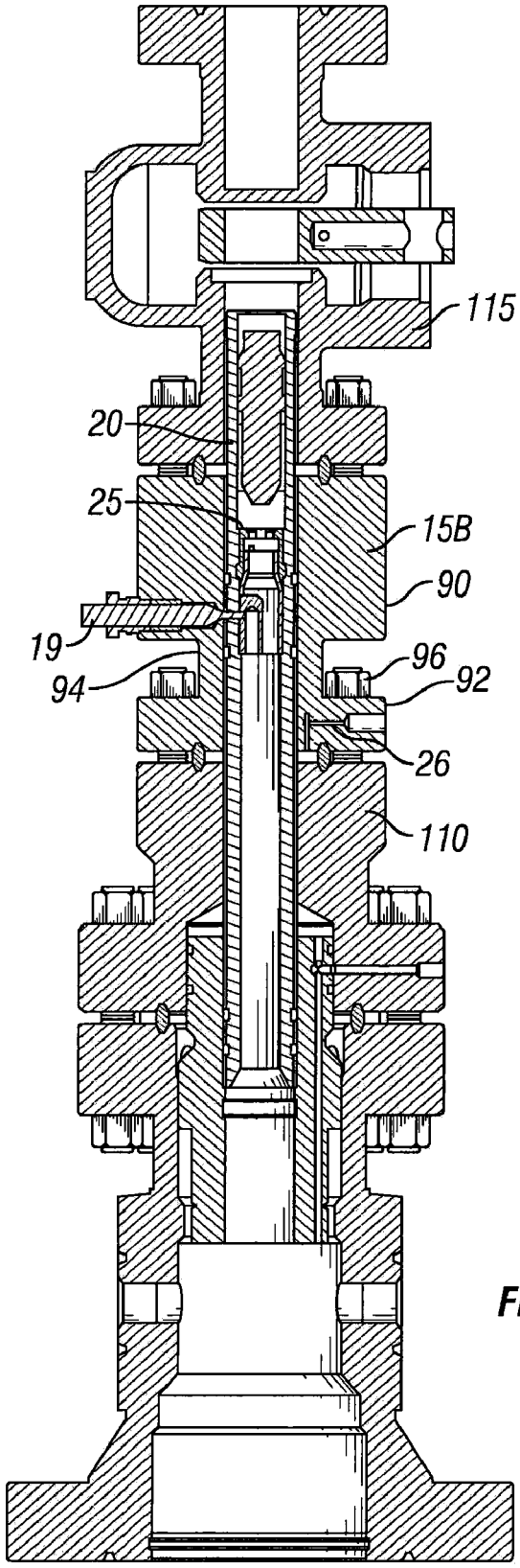
FIG. 8 is a cross-sectional view of an exemplary embodiment of the injection string wellhead assembly.

Referring to FIG. 8, an alternative embodiment of flange 15B is illustrated. Here, flange 15B operates as discussed in the previous embodiments; however, in this embodiment, flange 15B has a taller vertical profile, thereby preventing the need to replace the stud bolts of the tubing head adapter. As shown, flange 15B has an upper portion 90 and lower portion 92. Upper portion 90 is taller than lower portion 92, with lower portion 92 being a height which allows the existing stud bolts 96 of tubing head adapter 110 to be used to connect flange 15B to adapter 110.

An annular groove 94 is located around flange 15B in between upper portion 90 and lower portion 92. Lower portion 92 has bolt holes (not shown) for receiving bolts 96 of tubing head adapter 110. Since lower portion 92 is short enough to receive existing bolts 96, there is no need to replace bolts 96 with longer bolts. As such, flange 15B can be readily applied to existing tubing head adapters. Integral needle valve 19 is located within upper portion 90, while test port 26 is located within lower portion 92. The design and operation of these components are identical to those embodiments previously discussed. Please note, however, that one ordinarily skilled in the art will appreciate that other flange profiles may be utilized depending on the bolt length and/or design of the head adapter.

The present invention may also be used with multi-completion wellbores (e.g., dual completions having two or more production tubing strings). For a multi-completion well, the flange would include two or more internal bores with each bore adapted to receive a mandrel and injection tubing hanger within the mandrel. The plurality of internal production bores through the flange may be of different diameters to correspond to different size production tubing (e.g., a 3½×2⅞ inch dual completion).

Figure 9A:
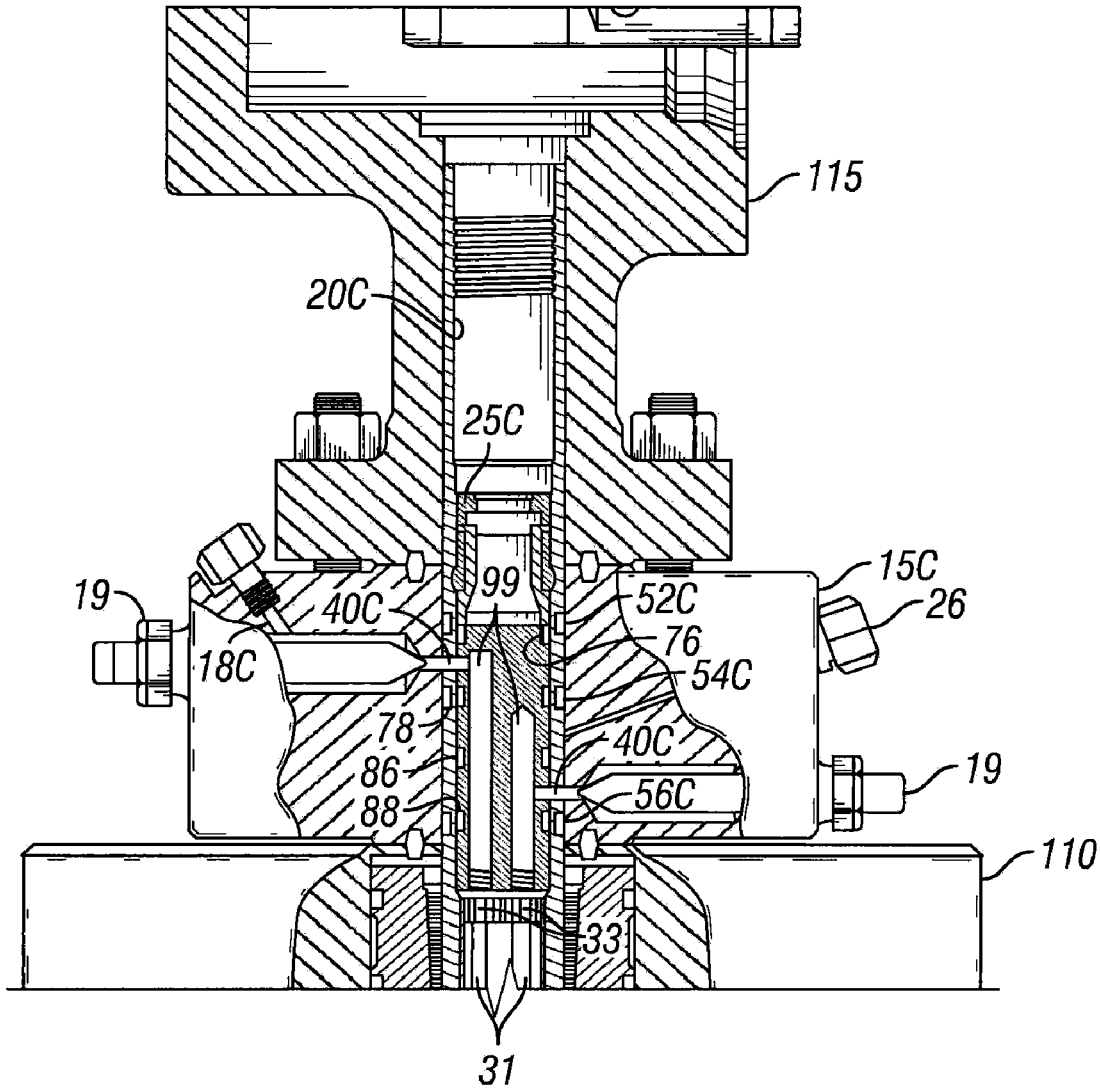
FIG. 9A is a cross-sectional view of an exemplary embodiment of the injection wellhead assembly having multiple strings hung from the hanger.
Figure 9B:
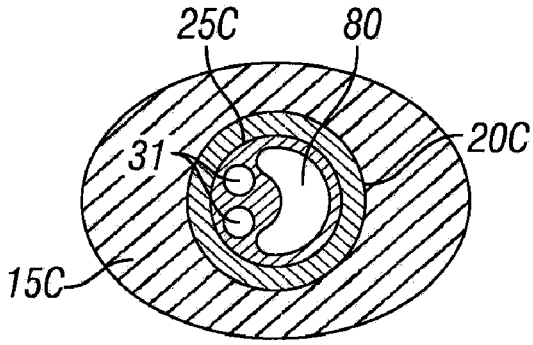
FIG. 9B is a sectional top-side view of the exemplary embodiment of FIG. 9A.

Referring to the exemplary embodiment of FIGS. 9A and 9B, the present invention may also comprise multiple injection tubing strings hung from the hanger. In this embodiment, each tubing string has its own individual fluid flow path as discussed in previous embodiments and may encompass any combination of those features. Those skilled in the art will appreciate that the present disclosure encompasses such alternative embodiments. There are, however, a few modifications which will be discussed below in relation to FIGS. 9A and 9B.

Referring to FIG. 9A, the wellhead assembly of this exemplary embodiment includes two capillary strings 31, each having respective fluid communication pathways as described in previous embodiments. Flange 15C includes two injection ports 18C (although only one is shown) and their corresponding needle valves 19, which also operate as discussed in previous embodiments. Here, one injection port 18C is located above the other lower injection port 18C. However, those skilled in the art will appreciate that the exact location of the ports and their corresponding flow paths could be varied as desired.

Mandrel 20C includes two flow ports 40C; each port 40C communicating with its respective injection port 18C. In addition to seal rings 52 and 54 used to seal the annular space above and below single flow port 40 of previous embodiments, the present embodiment utilizes one additional seal ring 56C. Seal ring 56C is used to seal the annular space below the lower flow port 40C, while seal ring 54C is used to seal the annular space above lower port 40. Ring seals 52C, 54C and 56C keep injection chemicals from leaking between mandrel 20C and flange 15C as previously discussed.

Hanger 25C also operates as previous discussed in relation to other embodiments. In this embodiment, however, in addition to seal rings 76 and 78 used to seal the annular space between hanger 25C and mandrel 20C above flow port 40C, two additional seal rings 86,88 are used to seal the annular space above and below the lower flow port 40C, respectively. Therefore, chemicals can be injected through each injection port 18C, through each corresponding flow port 40C and into each corresponding channel 75 (FIG. 4A) where the chemicals will flow until they reach each corresponding passageway 60 (FIG. 4A), whereafter the chemicals can pass into the respective tubing string 31.

The injection tubing strings 31 of FIG. 9A are each attached to hanger 25C with a connector 33, which operates are discussed in relation to previous embodiments. Here, of course, instead of a single profile including profiles 62 and 65 (discussed in relation to FIG. 4A), hanger 25C will comprise dual profiles 99 (each comprising profile 62,65 and their corresponding communication passageways 60 and channels 75) for allowing fluid communication to tubing strings 31. The exemplary embodiment of FIG. 9B illustrates a top view of hanger 25C also having C-shaped flow area 80 as discussed in previous embodiments. Here, however, hanger 25C includes dual profiles 99 for communicating with tubing strings 31.

In other applications, particularly in offshore platforms, it may be difficult, impractical, or prohibitively expensive to raise the height of the wellhead and/or Christmas tree due to existing flow lines extending from the individual wells on the platform. In such situations, embodiments of the present invention may be used by replacing an existing wellhead apparatus with a similar apparatus having identical, or substantially identical, dimensions and having an injection port in communication with the longitudinal bore of the wellhead apparatus. By substituting a similar wellhead apparatus that has the same, or substantially the same dimensions, the height of the wellhead and/or Christmas tree will remain the same so that existing flow lines may be utilized.

FIGS. 10B, 11B, and 12B illustrate exemplary embodiments of various wellhead apparatuses that have been substituted for original wellhead apparatuses in order to maintain the height of the wellhead and/or Christmas tree. Examples of wellhead apparatuses that may be modified to include an injection port in accordance with the invention include tubing head adapters, flange by flange single gate valves, multi block valve Christmas trees, composite Christmas trees, spacer spools, instrument flanges, bleed rings and bleed ring gaskets, essentially covering any individual Christmas tree apparatus which could be used, to comprise a vertical bore portion of a Christmas tree. Such apparatuses are well known in the art.

Figure 10A:
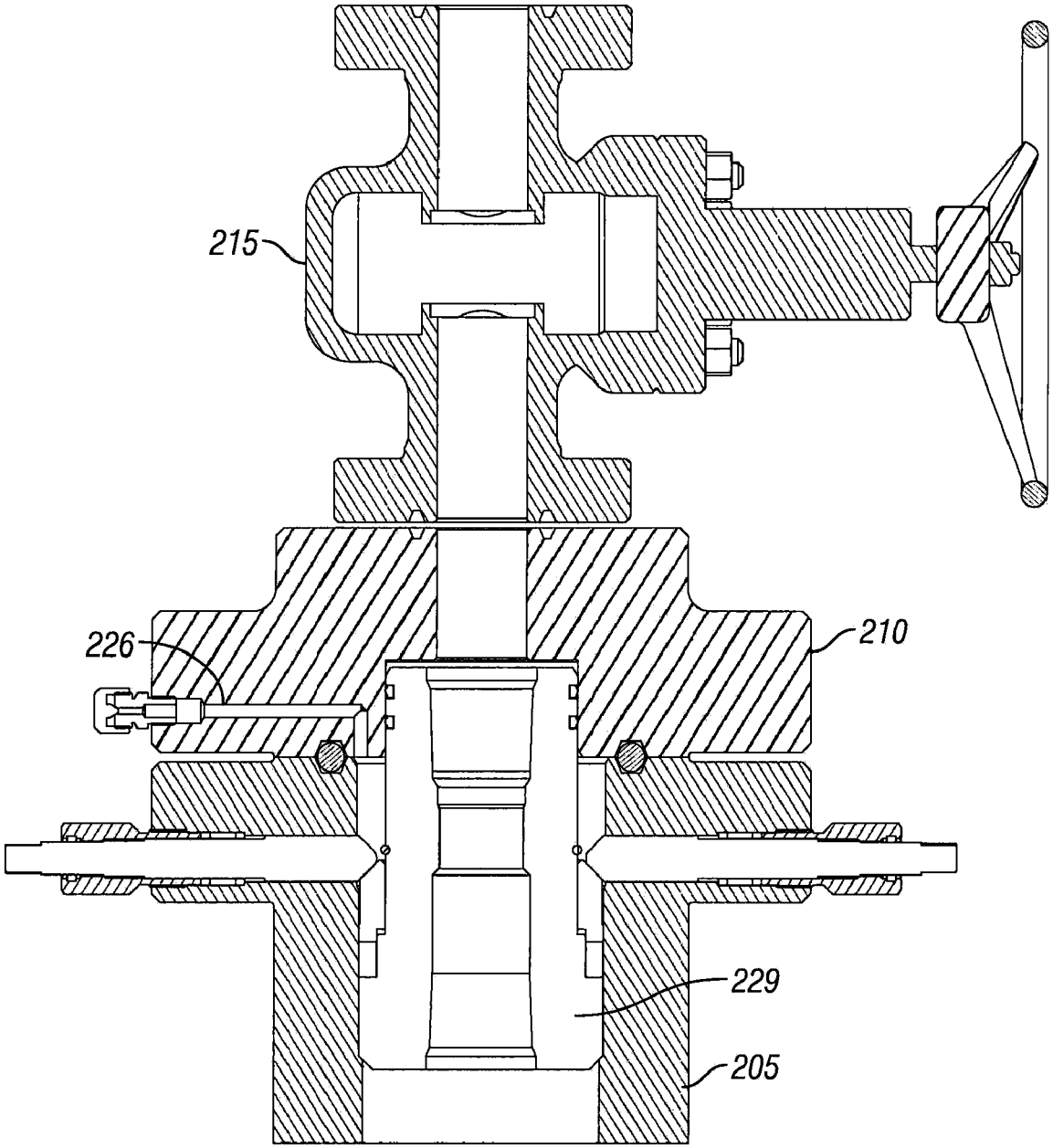
FIGS. 10A and 10B are cross-sectional views of a well before and after installation of an exemplary embodiment of the injection string wellhead assembly.

FIG. 10A shows a wellhead prior to installation of an injection tubing string. The wellhead includes tubing head 205, tubing head adapter 210, tubing hanger 229 and lower master valve 215. Tubing head adapter 210 includes test port 226. Production tubing (not shown) is suspended from the wellhead via tubing hanger 229. Wellbore fluids are produced up the production tubing, through hanger 229, through the longitudinal bores extending through tubing head adapter 210 and valve 215, and out a flowline (not shown) connected to the upper Christmas tree above valve 215. Such an arrangement is well known in the art.

FIG. 10B illustrates the wellhead after the wellhead assembly for an injection tubing string has been installed. The wellhead assembly includes tubing head adapter 210A, mandrel 20 and injection tubing hanger 25. Tubing head adapter 210A has been substituted for tubing head adapter 210 of FIG. 10A. Tubing head adapter 210A includes injection port 218 and grease fitting 221. Injection port 218 extends through the tubing head adapter and is in communication with the longitudinal bore through adapter 210A. Tubing head 205, tubing hanger 229 and lower master valve 215 remain the same. Since tubing head adapter 210A has substantially the same dimensions as adapter 210, the overall height of the wellhead and Christmas tree is substantially the same. Accordingly, existing flow lines may be utilized with the wellhead assembly shown in FIG. 10B.

As with earlier embodiments, mandrel 20 is landed and locked into the back pressure valve profile in tubing hanger 229. The length of mandrel 20 is selected so that it does not interfere with the operations of valve 215 (i.e., the mandrel does not prevent the valve from being opened or closed). Preferably, mandrel 20 includes an internal profile for receiving a back pressure valve. Injection tubing hanger 25 and the injection tubing string (not shown in FIG. 10B) are lowered through the Christmas tree until hanger 25 lands inside mandrel 20. In a preferred embodiment, a snap ring on the external surface of hanger 25 snaps into a mating profile on the internal surface of mandrel 20 to lock the hanger to the mandrel. Mandrel 20 includes upper and lower external seals, 52 and 54, which seal the annular space between mandrel 20 and tubing head adapter 210A and between mandrel 20 and tubing hanger 229, respectively. Hanger 25 includes seals on its external surface to seal the annular space above and below passageway 60. Chemicals may be injected through injection port 218, through the annular space between mandrel 20 and tubing hanger 229, through flow port 40 in mandrel 20, through passageway 60 and into the injection tubing string, which communicates with passageway 60.

FIG. 11B illustrates another embodiment of this invention. In this embodiment, master gate valve 215A is substituted for original gate valve 215. Gate valve 215A has substantially the same dimensions of original gate valve 215. Since the remaining wellhead and Christmas tree equipment are used with the wellhead assembly in FIG. 11B, existing flow lines may be utilized. Gate valve 215A includes injection port 218A which extends through the lower flange, between the bolt holes in the flange (not shown), and communicates with the longitudinal bore of the valve. Injection port 218A may include grease fitting 221A.

Mandrel 20 is landed in the back pressure profile in tubing hanger 229 and extends into the lower end of longitudinal bore 235 of valve 215A. The upper end of mandrel 20 does not interfere with operation of valve 215A. Chemicals may be injected through injection port 218A, through the annular space between mandrel 20 and the longitudinal bores of gate valve 215, tubing head adapter 210 and tubing hanger 229 between upper seal 52 and lower seal 54, through flow port 40 in mandrel 20, through passageway 60 in hanger 25 and into the injection tubing string.

Figure 12A:
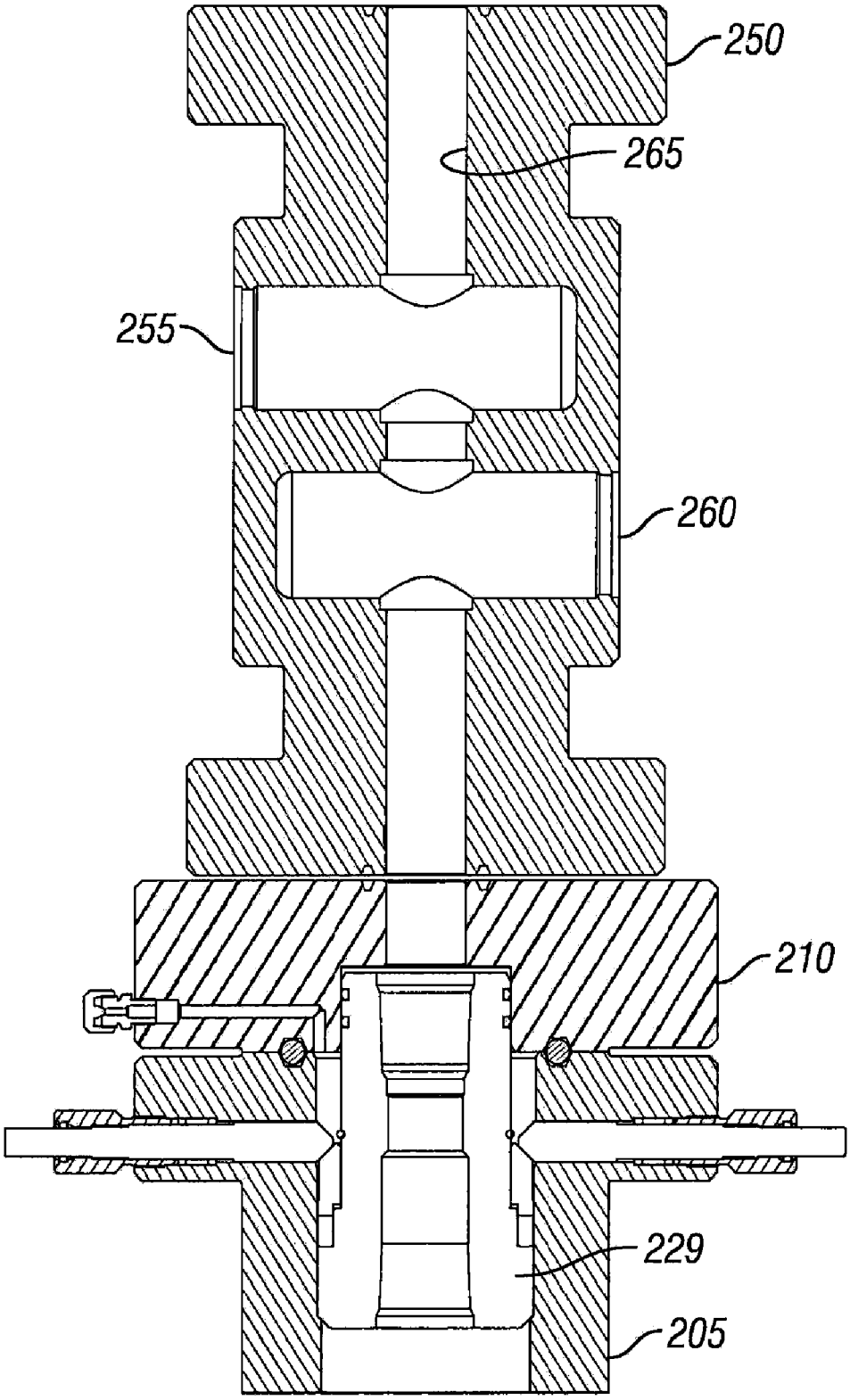
FIGS. 12A and 12B are cross-sectional views of a well before and after installation of an exemplary embodiment of the injection string wellhead assembly.
Figure 12B:
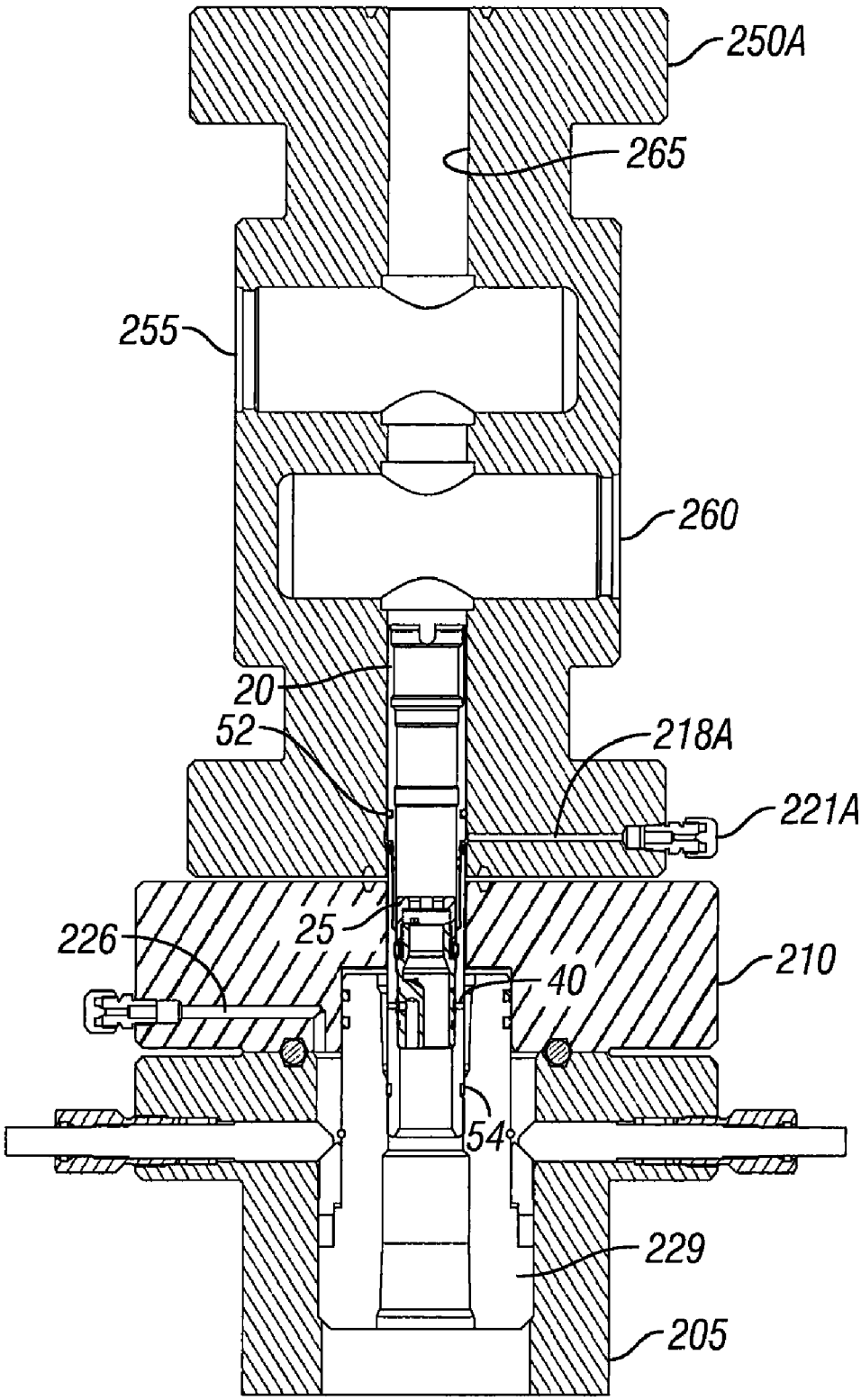

FIG. 12A illustrates a well having a multi block Christmas tree 250 mounted on top tubing head adapter 210 and tubing head 205. Multi block tree 250 includes upper and lower master gate valves 255 and 260. Longitudinal bore 265 extends through the entire length of tree 250, including through the upper and lower master gate valves. The components of valves 255 and 260 are not shown but construction and operations of such valves are well known in the art.

The wellhead assembly for an injection tubing string as illustrated in FIG. 12B includes a modified multi block tree 250A, mandrel 20 and injection string hanger 25. As with the modified wellhead apparatuses illustrated in FIGS. 10B and 11B, tree 250A is built to substantially the same dimension as the wellhead apparatus it replaces, in this embodiment tree 250, to permit use of existing flow lines. Modified tree 250A includes injection port 218A which extends through the lower flange of the tree and communicates with longitudinal bore 265. Mandrel 20 is landed in the back pressure profile of tubing hanger 229 and includes upper external seal 52 to seal the annular space between the upper end of mandrel 20 and longitudinal bore 265 above injection port 218A. Similarly, mandrel 20 includes lower seals 54 to seal the annular space between the lower end of mandrel 20 and tubing hanger 229.

The injection tubing string (not shown) is attached to hanger 25 and hanger 25 is landed and locked as described above inside mandrel 20. Mandrel 20 preferably includes an internal profile for receiving a back pressure valve. The height of mandrel 20 is selected so that it does not prevent operations of master valves 255 or 260. Chemicals may be injected through port 218A through the annular space surrounding mandrel 20 between seals 52 and 54, through flow port 40 in mandrel 20, through passage 60 of hanger 25 and into the injection tubing string.

In an alternative embodiment, the injection port may be drilled through an existing wellhead apparatus on the well site to establish communication with the longitudinal bore extending through the apparatus. Thereafter, mandrel 20, hanger 25 and an injection tubing string may be installed in the well as described above. The onsite drilling of the injection port may be necessary where logistic, timing, costs, supply or other constraints prevent the installation of a substitute wellhead apparatus.

As with earlier embodiments, hanger 25 of the wellhead assembly of FIGS. 10B, 11B and 12B may include an annular channel extending around an outer surface of the hanger, the annular channel intersecting communication passageway 60 of the hanger to allow fluid communication when port 40 of the mandrel is not radially aligned with passageway 60.

Although various embodiments have been shown and described, the invention is not so limited and will be understood to include all such modifications and variations as would be apparent to one skilled in the art, as well as related methods. For example, a wellhead assembly having three or more tubing strings and their respective flow paths can be envisioned within the scope of the present disclosure. Accordingly, the invention is not to be restricted except in light of the attached claims and their equivalents.

What is claimed is:

1. A wellhead assembly for an injection tubing string, the wellhead assembly comprising:

a wellhead apparatus having a longitudinal bore therethrough and an injection port, the injection port extending through the wellhead apparatus and communicating with the longitudinal bore of the wellhead apparatus;

a mandrel adapted to be inserted into the longitudinal bore of the wellhead apparatus, the mandrel comprising a longitudinal bore therethrough and a port, the port extending through the mandrel for communicating between the injection port of the wellhead apparatus and the longitudinal bore through the mandrel; and a hanger connected to the injection tubing string, the hanger being adapted to land in the longitudinal bore of the mandrel, the hanger comprising a communication passageway which facilitates fluid communication of an injected fluid between the port of the mandrel and the injection tubing string, the hanger further comprising a longitudinal flow area therethrough for the production of fluids from a wellbore and up past the hanger.

2. The wellhead assembly of claim 1, wherein the hanger further comprises a swivel connection connecting the hanger to the injection tubing string, the swivel connection allowing rotation of the hanger without imparting rotation to the injection tubing string.

3. The wellhead assembly of claim 1, wherein the mandrel further comprises a connector proximate a lower end of the mandrel, the connector allowing the mandrel to be connected to a back pressure valve profile of a production tubing hanger.

4. The wellhead assembly of claim 1, wherein the mandrel further comprises a connector for receiving a back pressure valve in the longitudinal bore of the mandrel above the hanger.

5. The wellhead assembly of claim 1, wherein the hanger further comprises a connector for connecting a running tool.

6. The wellhead assembly of claim 1, wherein the hanger further comprises an annular channel extending around an outer surface of the hanger, the annular channel of the hanger intersecting the communications passageway of the hanger, thereby allowing fluid communication when the port of the mandrel and the communications passageway of the hanger are not radially aligned.

7. The wellhead assembly of claim 1, wherein the wellhead apparatus is a tubing head adapter mounted beneath a master gate valve and above a tubing head, the mandrel being such a height that the mandrel does not prevent closure of the master gate valve.

8. The wellbore assembly of claim 1 wherein the wellhead apparatus is a master gate valve, and wherein the mandrel extends into a lower bore of the master gate valve but does not prevent closure of the master gate valve.

9. The wellbore assembly of claim 1 wherein the wellhead apparatus is a multi block tree, the tree having one or more master gate valves, and wherein the mandrel being such a height that the mandrel does not prevent closure of the one or more master gate valves.

10. A method for injecting fluid through a wellhead assembly and an injection tubing string, the method comprising the steps of:

(a) mounting a wellhead assembly to a wellhead, the wellhead assembly comprising a wellhead apparatus adapted to be connected to the wellhead, the wellhead apparatus having a longitudinal bore therethrough and a fluid injection port, a mandrel adapted to be inserted into the longitudinal bore of the wellhead apparatus, the mandrel having a bore therethrough and a port, and a hanger connected to the injection tubing string, the hanger being adapted to land inside the bore of the mandrel, the hanger comprising a communications passageway facilitating fluid communication between the port of the mandrel and the injection tubing string, the hanger further comprising a longitudinal flow area therethrough for the production of fluids from a wellbore and up past the hanger;

(b) injecting fluid through the fluid injection port of the wellhead apparatus;

(c) injecting the fluid through the port of the mandrel;

(d) injecting the fluid through the communications passageway of the hanger; and (e) injecting the fluid through the injection tubing string.

11. The method of claim 10, wherein the wellhead apparatus comprises a vertical bore portion of a Christmas tree.

12. The method of claim 10, wherein the mandrel extends into a lower bore of a master gate valve.

13. The method of claim 12, the method further comprises the step of closing the master gate valve without damaging the injection tubing string.

14. The method of claim 10 further comprising providing a profile in the mandrel for receiving a back pressure valve.

15. The method of claim 10 further comprising drilling the fluid injection port into the wellhead apparatus, the drilling of the fluid injection port performed at a location of a well.

16. A method for injecting fluid into a well comprising the steps of:

replacing a first wellhead apparatus on a wellhead with a second wellhead apparatus having substantially the same dimensions as the first wellhead apparatus, the second apparatus having a longitudinal bore extending therethrough;

providing the second wellhead apparatus with an injection port that communicates with the longitudinal bore of the second wellhead apparatus;

installing a mandrel in the longitudinal bore of the second wellhead apparatus, the mandrel having a longitudinal bore therethrough and a port;

connecting an injection tubing string to a hanger;

landing the hanger in the longitudinal bore of the mandrel, the hanger having a passageway to facilitate fluid communication between the port of the mandrel and the injection tubing string, the hanger further having a longitudinal flow area therethrough for the production of fluids from a wellbore and up past the hanger; and injecting fluid through the injection port of the wellhead apparatus, through the port in the mandrel, through the passageway of the hanger and into the injection tubing string.

17. The method of claim 16 further comprising landing the mandrel in a back pressure valve profile located in a production tubing hanger in the wellhead.

18. The method of claim 16 further comprising providing a valve above the mandrel, wherein the valve is in communication with the longitudinal bore of the wellhead apparatus, and wherein the mandrel does not interfere with operation of the valve.

* * * * *